US007201590B1

(12) United States Patent
Chen

(10) Patent No.: US 7,201,590 B1
(45) Date of Patent: Apr. 10, 2007

(54) WATER-RESISTANT ELECTRIC CONNECTOR ASSEMBLY

(75) Inventor: Tsang-I Chen, Taipei (TW)

(73) Assignee: Swain Industry Co., Ltd., Taipei (TW)

( * ) Notice: Subject to any disclaimer, the term of this patent is extended or adjusted under 35 U.S.C. 154(b) by 0 days.

(21) Appl. No.: 11/488,772

(22) Filed: Jul. 19, 2006

(51) Int. Cl.
*H01R 13/44* (2006.01)

(52) U.S. Cl. ..... 439/142

(58) Field of Classification Search ..... 439/142, 439/144, 206, 434
See application file for complete search history.

(56) References Cited

U.S. PATENT DOCUMENTS 3,078,436 A * 2/1963 Berry ..... 439/579
3,716,815 A * 2/1973 Riches ..... 439/142
4,245,875 A * 1/1981 Shaffer et al. ..... 439/144
4,312,553 A * 1/1982 Lyckesjo ..... 439/281
4,952,160 A * 8/1990 Olsen ..... 439/142
5,722,847 A * 3/1998 Haag ..... 439/320
6,089,888 A * 7/2000 Miller ..... 439/142

* cited by examiner

*Primary Examiner*—Phuong Dinh
(74) *Attorney, Agent, or Firm*—Browdy and Neimark, PLLC

(57) ABSTRACT

A water-resistant electric connector assembly includes a first electric connector, which is provided with a coupling member and conductive terminals arranged on the inside, and a second electric connector, which has a coupling portion for fastening to the coupling member of the first electric connector, contact terminals arranged on the inside for contacting the conductive terminals of the first electric connector, and a tapered stop flange extending around the periphery for stopping outside water from entering the electric connector assembly.

12 Claims, 7 Drawing Sheets

WATER-RESISTANT ELECTRIC CONNECTOR ASSEMBLY

BACKGROUND OF THE INVENTION

1. Field of the Invention

The present invention relates generally to electric connectors, such as electric plugs and electric sockets, and more particularly to a water-resistant electric connector assembly comprising a pair of coupled electric connectors.

2. Description of the Related Art

Conventional electric connectors, such as electric plugs and electric sockets, do not provide a water-resistant structure or a satisfactory water-resistant effect. When a conventional electric plug is connected to a conventional electric socket, water may unintentionally enter the inside of the electric plug and the electric socket accidentally, resulting in short-circuit. When the user touches the short-circuited electric appliance, an electric shock may occur and hurt the user.

There is known a water-resistant electric connector. A water-resistant electric connector, for example, an electric plug of this design has a mounting groove on the surface, and a water-resistant cover mounted in the mounting groove. Because the water-resistant cover is kept in flush with the surface of the electric plug, it cannot effectively prohibit outside water from flowing to the inside of the electric plug if the water-resistant cover is not heavily clamped. Further, when the electric plug is not connected to an electric socket, moisture and dust will enter the inside of the electric plug to contaminate or wet the internal circuit, resulting in damage or short-circuit of the internal circuit.

In addition, the power cable of the conventional electric plug or socket tends to be disconnected from the contact terminals when the power cable is not properly fixed in position and pulled by an external force.

SUMMARY OF THE INVENTION

The present invention has been accomplished under the circumstances in view. It is one objective of the present invention to provide a water-resistant electric connector, which has a stop flange extending around the periphery to prohibit outside water from flowing to the inside of the electric connector, thereby preventing a short-circuit.

It is another objective of the present invention to provide a water-resistant electric connector, which has a cover for covering the receiving open side of the electric connector to block outside moisture and dust when the electric connector assembly is not used.

It is still another objective of the present invention to provide a water-resistant electric connector, which uses two retaining members to hold down the cable, preventing disconnection of the cable from the contact terminals when an external force stretches the cable.

To achieve these objectives of the present invention, the water-resistant electric connector assembly comprises a first electric connector and a second electric connector. The first electric connector comprises a connector body, a plurality of conductive terminals mounted inside the connector body, a cable inserted into the connector body and electrically connected to the conductive terminals in the connector body, and a coupling member mounted around the connector body. The second electric connector is connectable to the first electric connector, comprising a connector body and a cable. The connector body of the second electric connector has a receiving chamber formed in one end thereof, a plurality of contact terminals separately mounted inside the receiving chamber for contacting the conductive terminals of the first electric connector, a flat panel extending around a periphery thereof, a coupling portion extending from one side of the flat panel around the receiving chamber for the connection of the coupling member of the first electric connector, and a stop flange extending from the flat panel around said coupling portion. The stop flange has a proximity end connected to the flat panel and a distal end far away from the flat panel. The proximity end has a diameter smaller than said distal end. The cable of the second electric connector is inserted into the connector body of the second electric connector and electrically connected to the contact terminals inside the receiving chamber.

DETAILED DESCRIPTION OF THE INVENTION

Figure 1:
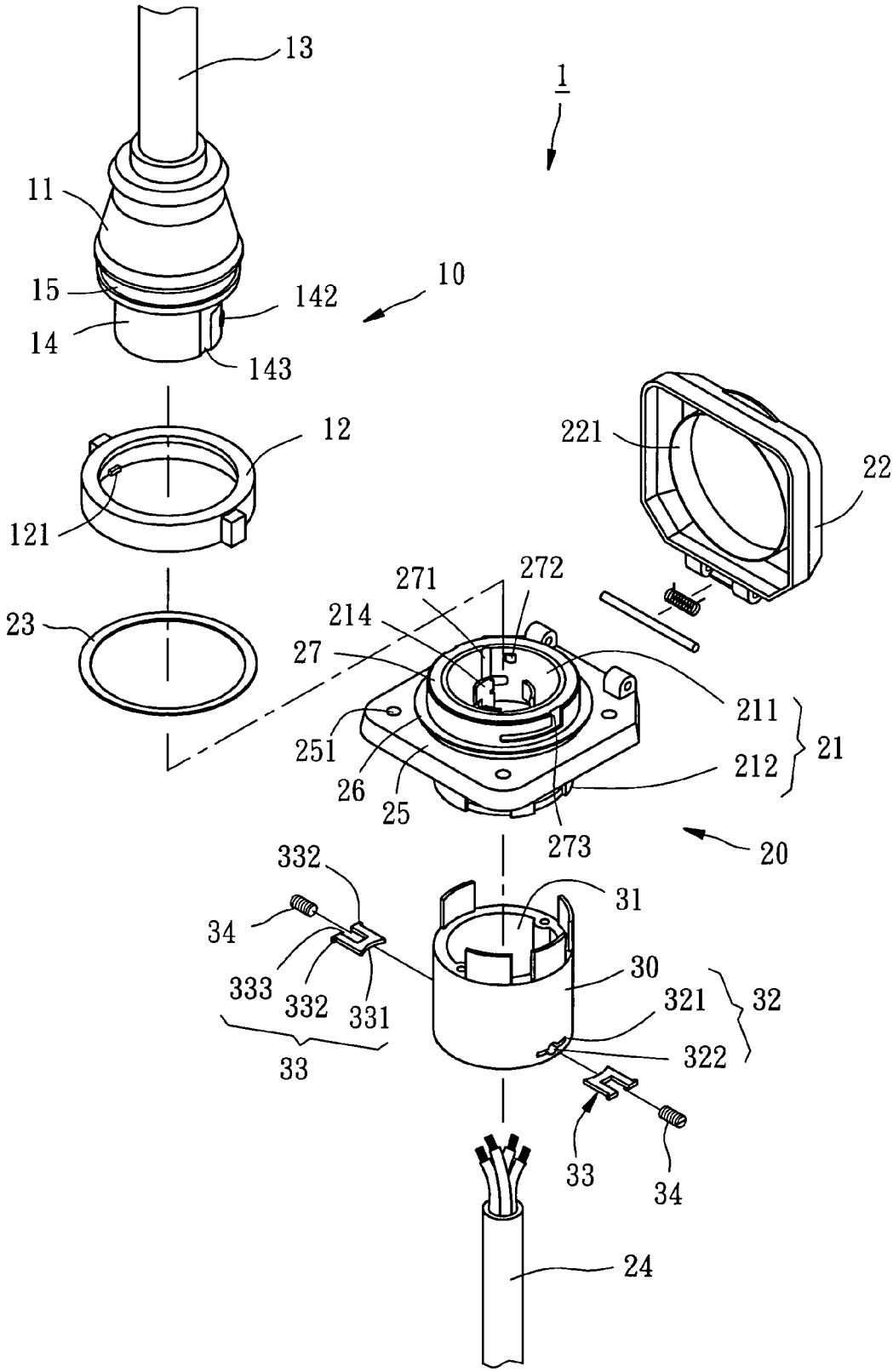
FIG. 1 is an exploded view of a water-resistant electric connector assembly in accordance with a first preferred embodiment of the present invention.
Figure 2:
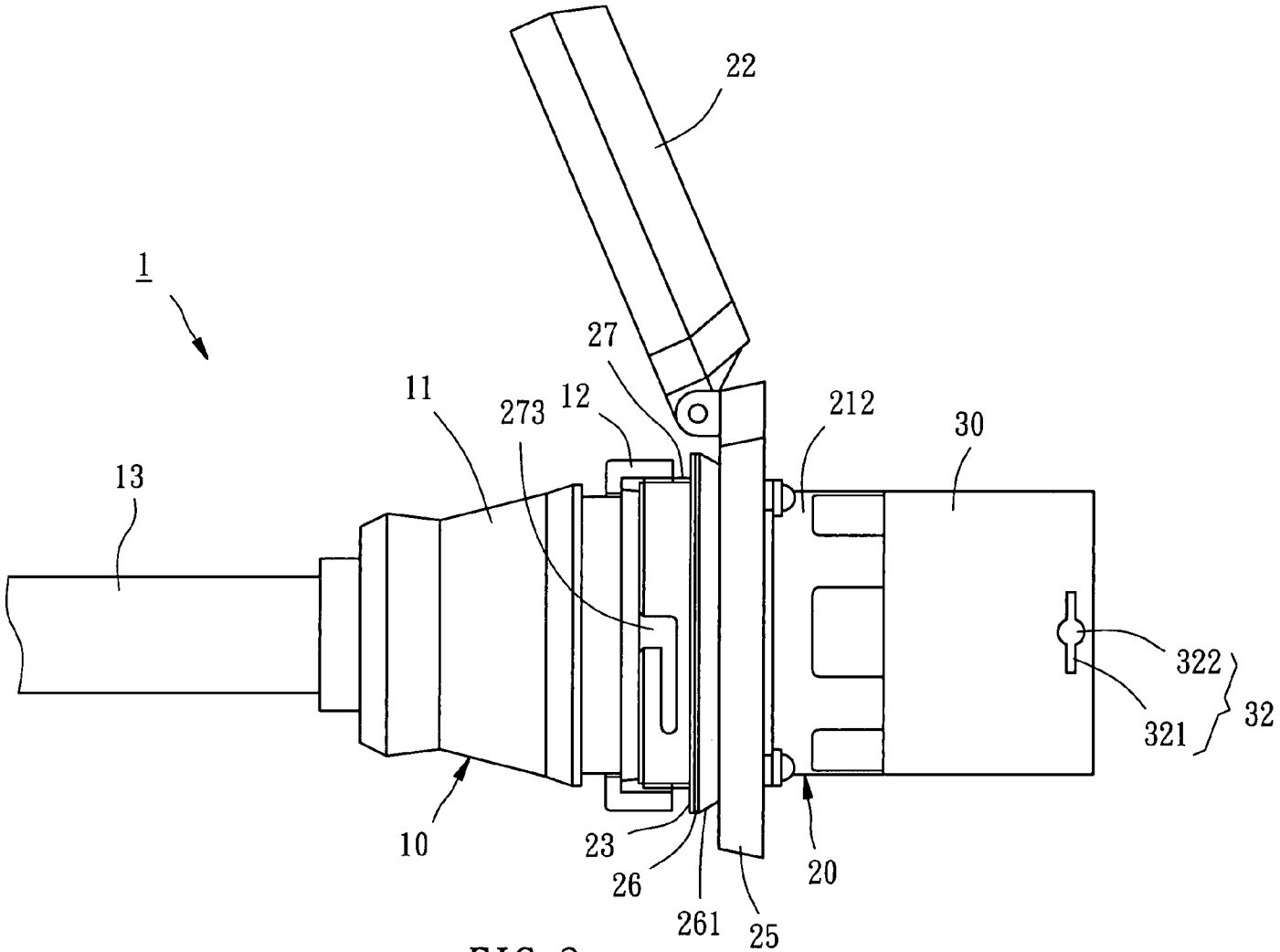
FIG. 2 is an assembly plane view of the water-resistant electric connector assembly according to the first preferred embodiment of the present invention.
Figure 3:
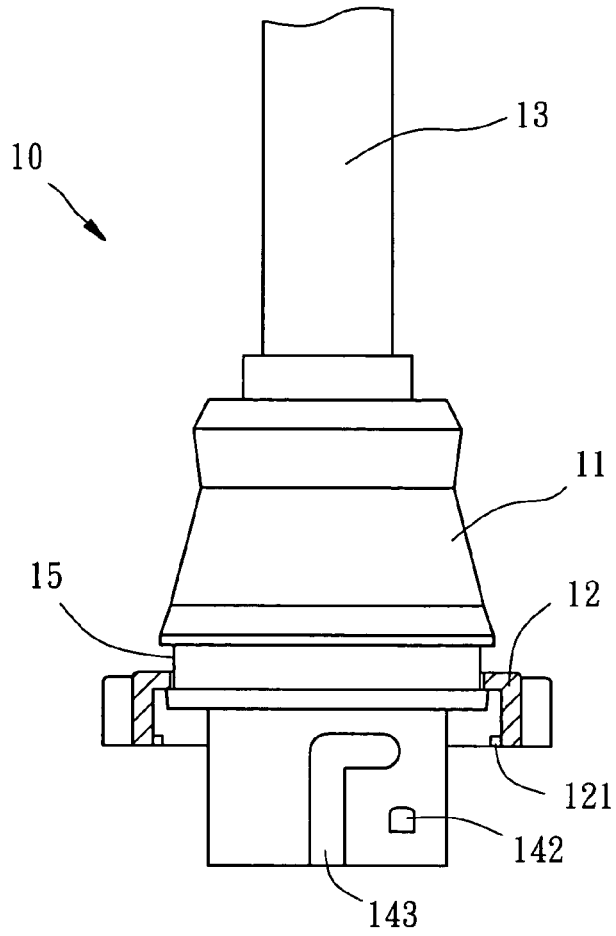
FIG. 3 is a plane view of the first electric connector of the water-resistant electric connector assembly according to the first preferred embodiment of the present invention.
Figure 4:
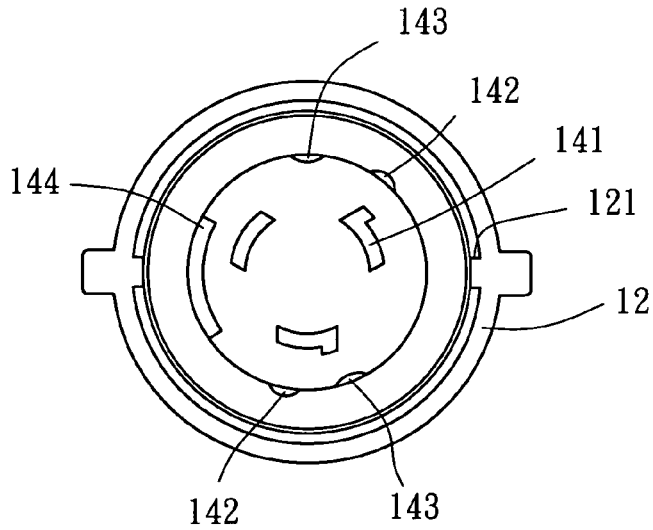
FIG. 4 is a bottom view of the first electric connector of the water-resistant electric connector assembly according to the first preferred embodiment of the present invention.
Figure 5:
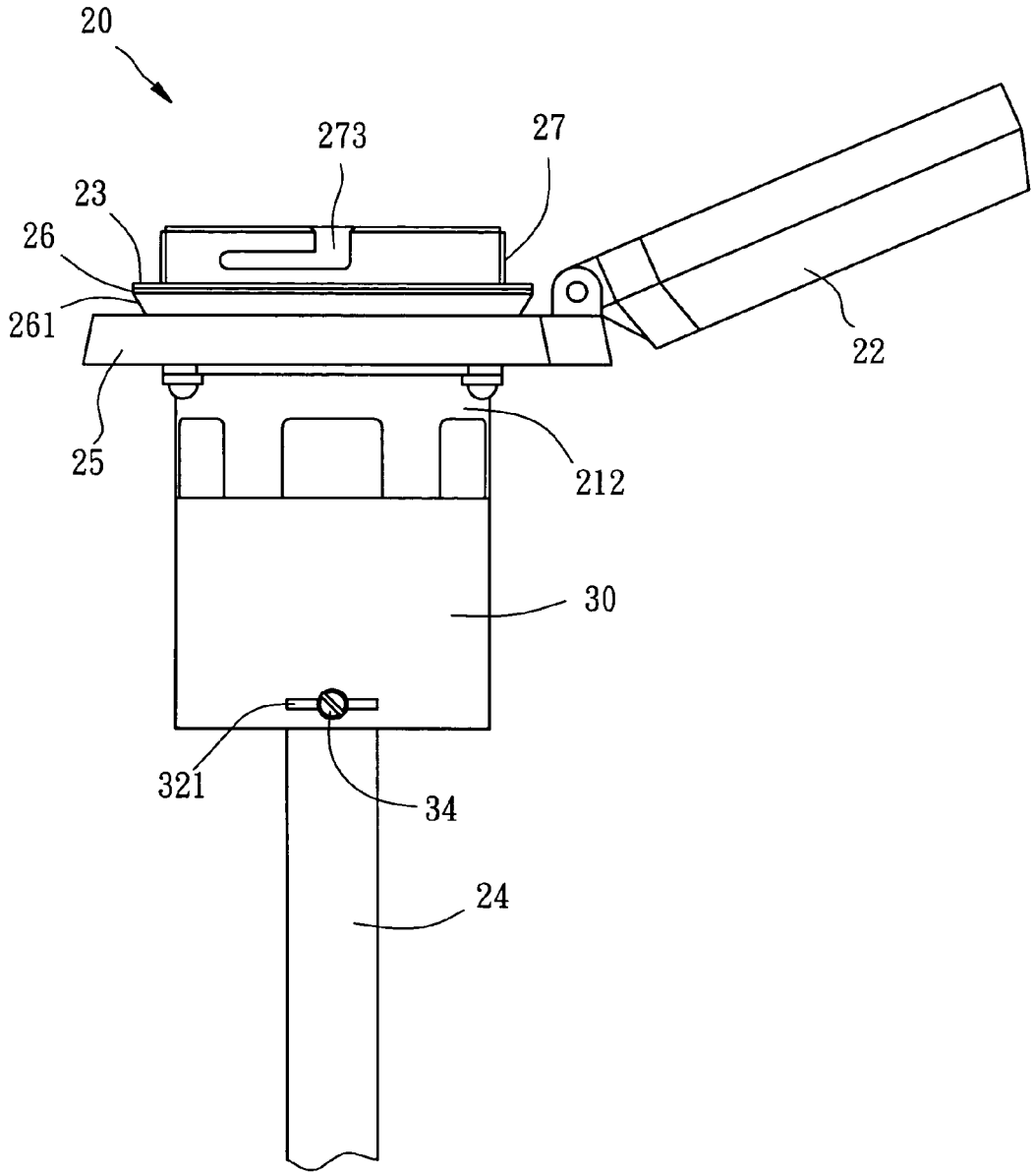
FIG. 5 is a plane view of the second electric connector of the water-resistant electric connector assembly according to the first preferred embodiment of the present invention.
Figure 6:
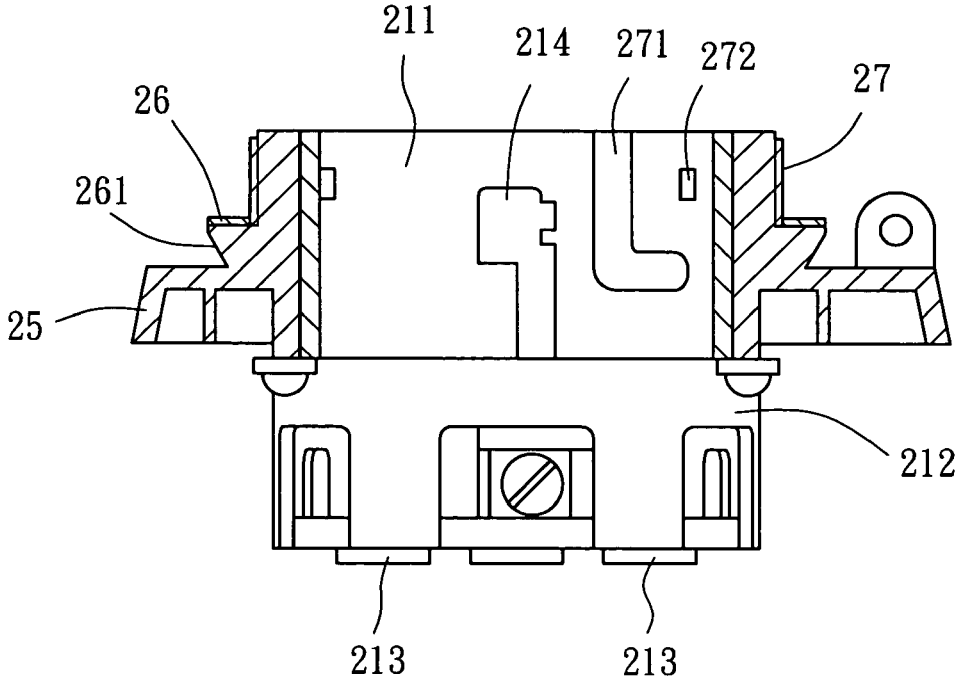
FIG. 6 is a sectional view of a part of the second electric connector of the water-resistant electric connector assembly according to the first preferred embodiment of the present invention.
Figure 7:
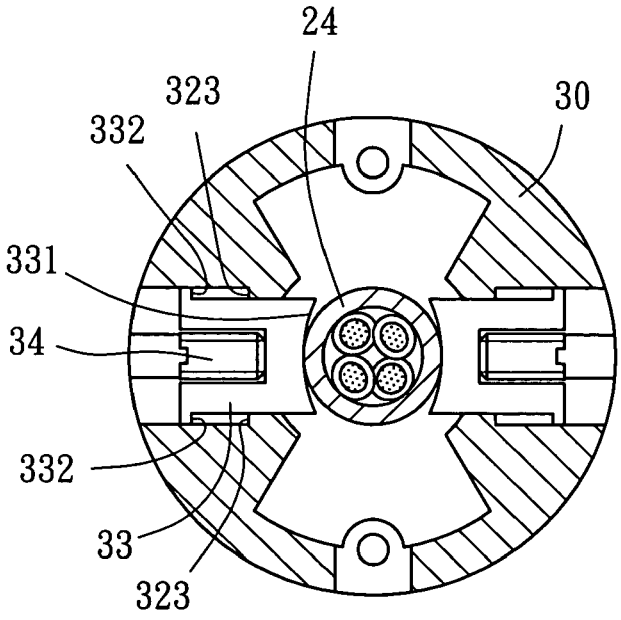
FIG. 7 is a bottom view of the locating member of the second electric connector of the water-resistant electric connector assembly according to the first preferred embodiment of the present invention.
Figure 8:
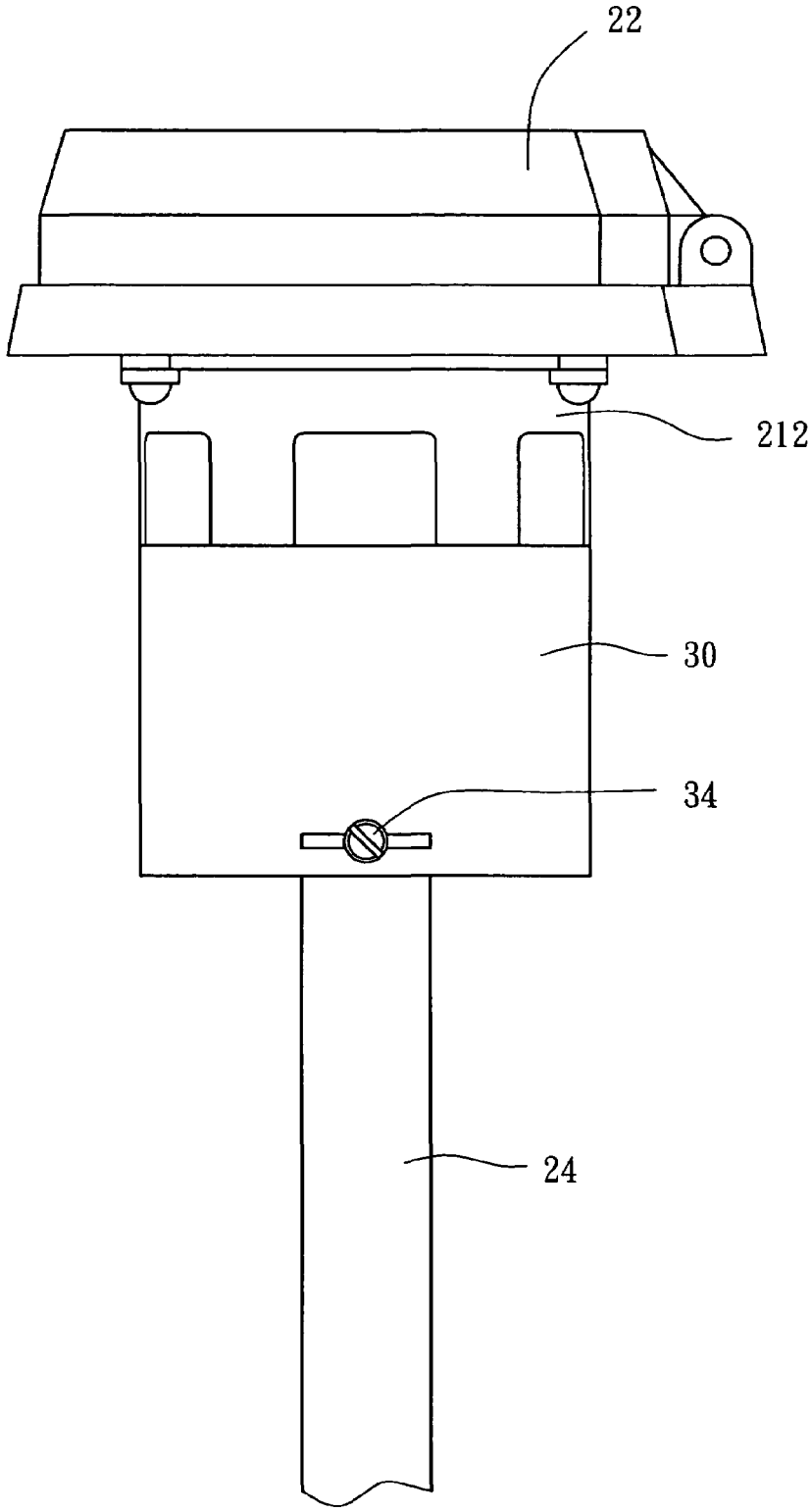
FIG. 8 is a schematic drawing of the second electric connector of the water-resistant electric connector assembly according to the first preferred embodiment of the present invention, showing the cover of the second electric connector closed.

As shown in FIGS. 1–8, an electric connector assembly 1 in accordance with a first preferred embodiment of the present invention comprises a pair of coupled electric connectors, namely a first electric connector 10, i.e. an electric socket, and a second electric connector 20, i.e. an electric plug.

The first electric connector 10 comprises a connector body 11, a coupling member 12, and a cable 13. The connector body 11 has a coupling portion 14 axially forwardly extended from the front side thereof, and a locating groove 15 extending around the periphery. The coupling portion 14 has three terminal slots 141 each holding a respective conductive terminal (not shown), and two raised portions 142 and two L-shaped grooves 143 and a guide rib 144 respectively formed on the periphery thereof. The coupling member 12 is coupled to the locating groove 15 of the connector body 11 and rotatable relative to the connector body 11, having two raised portions 121 bilaterally protruded from the inside wall thereof. The cable 13 has one end inserted into the connector body 11 and electrically connected to the conductive terminals in the terminal slots 141.

The second electric connector 20, i.e. the electric plug, comprises a connector body 21, a cover 22, a gasket ring 23, a cable 24, and a locating member 30. The connector body 21 comprises a receiving chamber 211 at one side, a holder frame 212 at an opposite side, a flat panel 25 extending around the periphery on the middle between the receiving chamber 211 and the holder frame 212, a coupling portion 27 extending from one side of the flat panel 25 and surrounding the receiving chamber 211, a stop flange 26 extending from the flat panel 25 around the coupling portion 27, a plurality of connection portions 213 at the holder frame 26 through which the power cable 24 is inserted into the connector body 21, three contact terminals 214 mounted inside the receiving chamber 211 and respectively connected to the cable 24 that is inserted into the holder frame 212, and a plurality of mounting through holes 251 provided at the flat panel 25 for the mounting of fastening members (not shown) to affix the flat panel 25 to the wall. The stop flange 26 is a conical stop flange having a tapered outer wall 261 sloping downwardly inwards, i.e., the tapered outer wall 261 has a diameter gradually reducing in direction from the coupling portion 27 toward the flat panel 25. When the second electric connector 20 is affixed to the wall (see FIG. 2) and when water is flowing on the surface of the flat panel 25, the flowing water will flow along the connection area between the stop flange 26 and the flat panel 25 toward the floor, i.e., water does not flow over the tapered outer wall 261 of the stop flange 26 to the distal end of the coupling portion 27 and therefore water is prohibited from flowing to the inside of the second electric connector 20. The gasket ring 23 is mounted on the stop flange 26. The coupling portion 27 has two L-shaped grooves 271, two raised portions 272 and a guide rib (not shown) on the inside wall thereof, and two L-shaped grooves 273 on the outside wall thereof. The cover 22 is coupled to one side of the flat panel 25 and adapted to cover the receiving chamber 211, coupling portion 27 and stop flange 26 of the connector body 21, having a press portion 221. When the cover 22 is closed, the press portion 221 is pressed on the gasket ring 23 against the stop flange 26 to seal the receiving chamber 211 against outside water and dust.

Referring to FIGS. 1, 2 and 7 again, the locating member 30 is fastened to the holder frame 211 of the connector body 21, having an axial through hole 31 cut through the two distal ends thereof for the passing of the cable 24, two stop portions 323 bilaterally disposed inside the axial through hole 31 on the middle, and two cut-through portions 32 at two sides of the periphery. Each cut-through portion 32 is comprised of an elongated slot 321 and a screw hole 322 at the center of the elongated slot 321. Further, two retaining members 33 are respectively mounted in the elongated slots 321 of the cut-through portions 32. Each retaining member 33 has an arched retaining portion 331 disposed at one end and stopped against the periphery of the cable 24 inside the axial through hole 31, two positioning portions 332 disposed at the other end and stopped at the associating stop portion 323, and a recessed mounting portion 333 defined between the two positioning portions 332. Further, a screw rod 34 is threaded into the screw hole 322 of each cut-through portion 32 and stopped at the recessed mounting portion 333 of the associating retaining member 33 and rotated to adjust the engagement between the respective retaining member 33 and the cable 24 and to prevent disconnection of the cable 24 from the contact terminals 214 when the cable 24 is stretched by an external force. According to this embodiment, the locating member 30 is an independent member connected to the holder frame 212 of the connector body 21. Alternatively, the locating member 30 can be formed integral with a part of the holder frame 212 of the connector body 21.

Referring to FIGS. 2–8 again, when the contact terminals 214 of the second electric connector 20 are respectively inserted into the terminal slots 141 of the first electric connector 10, the contact terminals 214 are kept in contact with the conductive terminals of the first electric connector 10 respectively, the guide rib 144 of the coupling portion 14 is stopped at the guide rib in the coupling portion 27, the raised portions 142 of the coupling portion 14 are respectively inserted into the L-shaped grooves 271 of the coupling portion 27, and the raised portions 272 of the coupling portion 27 are respectively inserted into the L-shaped grooves 143 of the coupling portion 14. When rotating the first electric connector 10 relative to the second electric connector 20 at this time subject to the extending direction of the L-shaped grooves 271, the raised portions 142 of the coupling portion 14 are respectively engaged with (the respective transverse sections) of the L-shaped grooves 271 of the coupling portion 27, and the raised portions 272 of the coupling portion 27 are respectively engaged with (the respective transverse sections) of the L-shaped grooves 143 of the coupling portion 14, and therefore the first electric connector 10 and the second electric connector 20 are firmly secured together. At this time, the coupling member 12 is rotated through an angle to force the raised portions 121 into engagement with the L-shaped grooves 273 of the coupling portion 27, keeping the coupling member 12 secured to the coupling portion 27 and stopped at the gasket ring 23 against the stop flange 26. Therefore, the gasket ring 23 and the tapered outer wall 261 of the stop flange 26 effectively seal the gap between the first electric connector 10 and the second electric connector 20. Further, when the second electric connector 20 is not used, the cover 22 is closed to seal the receiving chamber 211 against outside moisture and dust.

Figure 9:
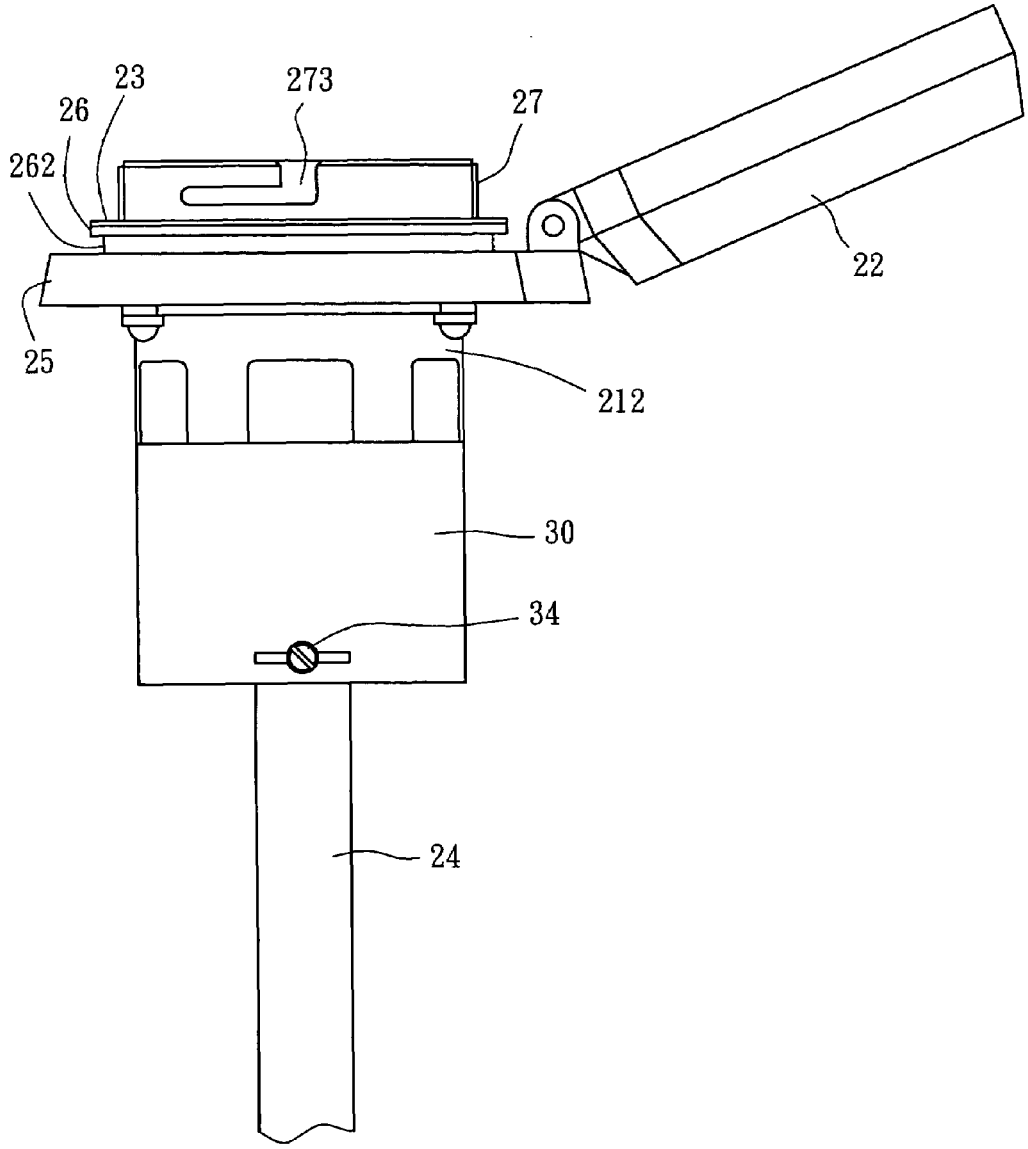
FIG. 9 is a schematic plain view of a second electric connector in accordance with a second preferred embodiment of the present invention.

FIG. 9 shows a water-resistant electric connector assembly 1 in accordance with a second embodiment of the present invention. According to this embodiment, the stop flange 26 has a T-shaped cross section so that a groove 262 is defined between the stop flange 26 and the flat panel 25 for guiding out water, and therefore water is prohibited from flowing over the stop flange 26 to the coupling portion 27 and the inside of the receiving chamber of the second electric connector.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A water-resistant electric connector comprising:

a connector body having a receiving chamber formed in one end thereof, a plurality of contact terminals separately mounted inside said receiving chamber, a flat panel extending around a periphery thereof, and a stop flange extending from one side of said flat panel around said receiving chamber, said stop flange having a proximity end connected to said flat panel and a distal end far away from said flat panel, said proximity end having a diameter smaller than said distal end; and a cable inserted into said connector body and electrically connected to said contact terminal wherein said connector body comprises a locating member disposed at one side of said fiat panel opposite to said receiving chamber, said locating member having an axial through hole cut through two distal ends thereof in communication with said receiving chamber, two cut-through portions cut through the periphery thereof at two opposite sides in communication with said axial through hole, said cut-through portions each comprising an elongated slot and a screw hole, and two retaining members respectively mounted in the elongated slots of said cut-through portions and stopped against said cable to secure said cable to said connector body.

2. The water-resistant electric connector assembly as claimed in claim 1, wherein said stop flange has a conical shape and a tapered outer wall, said tapered outer wall having a diameter gradually reducing toward said flat panel.

3. The water-resistant electric connector assembly as claimed in claim 1, wherein said stop flange has a T-shaped cross section, defining with said flat panel a groove around the periphery of said stop flange.

4. The water-resistant electric connector assembly as claimed in claim 1, further comprising a cover coupled to said flat panel for closing said receiving chamber.

5. The water-resistant electric connector assembly as claimed in claim 4, wherein said cover has a press portion for pressing on said stop flange when said cover is closed on said receiving chamber.

6. The water-resistant electric connector assembly as claimed in claim 1, wherein said retaining members each have an arched retaining portion disposed at one end thereof and inserted into the elongated slot of the associating cut-through portion and stopped against the periphery of said cable inside said axial through hole, and a mounting portion disposed at an opposite end thereof; said holder member further comprises two fastening screw members respectively threaded into the screw holes of said cut-through portions and stopped at the mounting portions of said retaining members to force said retaining members into engagement with the periphery of said cable.

7. A water-resistant electric connector assembly comprising:

a first electric connector having a connector body, a plurality of conductive terminals mounted inside the connector body, a cable inserted into the connector body and electrically connected to the conductive terminals, and a coupling member mounted around the connector body; and a second electric connector connectable to said first electric connector, said second electric connector having a connector body and a cable, the connector body of said second electric connector having a receiving chamber formed in one end thereof, a plurality of contact terminals separately mounted inside said receiving chamber for contacting the conductive terminals of said first electric connector, a flat panel extending around a periphery thereof, a coupling portion extending from one side of said flat panel around said receiving chamber for the connection of the coupling member of said first electric connector, and a stop flange extending from said flat panel around said coupling portion, said stop flange having a proximity end connected to said flat panel and a distal end far away from said flat panel, said proximity end having a diameter smaller than said distal end, the cable of said second electric connector being inserted into the connector body of said second electric connector and electrically connected to the contact terminals inside said receiving chamber wherein said connector body comprises a locating member disposed at one side of said fiat panel opposite to said receiving chamber, said locating member having an axial through hole cut through two distal ends thereof in communication with said receiving chamber, two cut-through portions cut through the periphery thereof at two opposite sides in communication with said axial through hole, said cut-through portions each comprising an elongated slot and a screw hole, and two retaining members respectively mounted in the elongated slots of said cut-through portions and stopped against said cable to secure said cable to said connector body.

8. The water-resistant electric connector assembly as claimed in claim 7, wherein said stop flange has a conical shape and a tapered outer wall, said tapered outer wall having a diameter gradually reducing toward said flat panel.

9. The water-resistant electric connector assembly as claimed in claim 7, wherein said stop flange has a T-shaped cross section, defining with said flat panel a groove around the periphery of said stop flange.

10. The water-resistant electric connector assembly as claimed in claim 7, further comprising a cover coupled to said flat panel for closing said receiving chamber.

11. The water-resistant electric connector assembly as claimed in claim 10, wherein said cover has a press portion for pressing on said stop flange when said cover is closed on said receiving chamber.

12. The water-resistant electric connector assembly as claimed in claim 7, wherein the connector body of said first electric connector has a locating groove extending around the periphery thereof; said coupling member of said first electric connector is coupled to said locating groove.

* * * * *